US011174860B2

(12) United States Patent
Coghlan et al.

(10) Patent No.: US 11,174,860 B2
(45) Date of Patent: Nov. 16, 2021

(54) PROGRESSIVE CAVITY PUMP WITH INTEGRATED HEATING JACKET

(71) Applicant: Roper Pump Company, Commerce, GA (US)

(72) Inventors: Edmond Tate Coghlan, Talmo, GA (US); Michael Andrew Ingram, Oakwood, GA (US); Zachariah Paul Rivard, Nicholson, GA (US)

(73) Assignee: Roper Pump Company, Commerce, GA (US)

( * ) Notice: Subject to any disclaimer, the term of this patent is extended or adjusted under 35 U.S.C. 154(b) by 357 days.

(21) Appl. No.: 15/939,670

(22) Filed: Mar. 29, 2018

(65) Prior Publication Data

US 2018/0283376 A1 Oct. 4, 2018

Related U.S. Application Data

(60) Provisional application No. 62/478,768, filed on Mar. 30, 2017.

(51) Int. Cl.
*F01C 1/10* (2006.01)
*F03C 2/00* (2006.01)
(Continued)

(52) U.S. Cl.
CPC ..... *F04C 15/0096* (2013.01); *F04C 2/1073* (2013.01); *F04C 2/1075* (2013.01);
(Continued)

(58) Field of Classification Search
CPC .... F04C 2/1073; F04C 2/1075; F04C 13/001; F04C 15/0061; F04C 15/0096;
(Continued)

(56) References Cited

U.S. PATENT DOCUMENTS 1,590,984 A 6/1926 Pfeil
2,463,341 A * 3/1949 Wade ..... F04C 2/1073 418/48

(Continued)

FOREIGN PATENT DOCUMENTS

CN 1715029 A 1/2006
DE 102012001617 A1 8/2013
EP 0683319 A1 1/2006

OTHER PUBLICATIONS

DE102012001617 A1—Conveying device e.g. spindle pump, for conveying e.g. fluid in food industry, has reservoir, inlet, outlet, rotor and stator, where reservoir is designed recess—and/or projection-free manner, and sealing unit cooled by washable mediums—ZETTL et al.—Aug. 1, 2013—English Transl. (Year: 2013).*

*Primary Examiner* — Theresa Trieu
(74) *Attorney, Agent, or Firm* — Snyder, Clark, Lesch & Chung, LLP

(57) ABSTRACT

A progressive cavity pump includes at least one of a jacketed stator casing and a jacketed inlet body. The jacketed stator casing includes a stator heating chamber, a stator assembly, and a rotor rotatably disposed within the stator assembly. The stator heating chamber forms a first space around the stator assembly and receives heating fluid therein. The stator assembly includes a cylindrical wall and a stator segment that forms a helically-convoluted chamber within the cylindrical wall. The jacketed inlet body includes an inlet heating chamber and a working fluid chamber in fluid communication with the helically-convoluted chamber. The inlet heating chamber forms a second space around the working fluid chamber and receives heating fluid therein. The stator heating chamber and the inlet heating chamber are isolated from each other, the helically-convoluted chamber, and the working fluid chamber.

20 Claims, 12 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 2/107*** | (2006.01) |
| ***F04C 13/00*** | (2006.01) |

(52) U.S. Cl.
CPC ..... *F04C 13/001* (2013.01); *F04C 15/0061* (2013.01); *F04C 2240/30* (2013.01)

(58) Field of Classification Search
CPC .. F04C 29/04; F04C 2240/30; F04C 2230/90; F04C 2230/91; F04C 2230/92; F01C 1/101
USPC ..... 418/48, 83, 101, 178–179
See application file for complete search history.

(56) References Cited

U.S. PATENT DOCUMENTS 3,127,530 A 3/1964 White
3,340,814 A * 9/1967 Streicher ..... F04C 2/1073 418/48
3,499,389 A * 3/1970 Fritz ..... F04C 2/1075 418/48
3,771,906 A 11/1973 Bourke
4,273,521 A * 6/1981 Baker ..... F04C 2/1075 418/48
4,329,128 A 5/1982 Forgues
4,854,373 A 8/1989 Williams
4,890,988 A 1/1990 Kramer et al.
5,038,853 A 8/1991 Callaway, Sr. et al.
5,284,427 A 2/1994 Wacker
5,377,495 A 1/1995 Daigle
5,494,193 A 2/1996 Kirschner et al.
5,688,114 A * 11/1997 Millington ..... F04C 2/1073 418/48
5,716,199 A 2/1998 Shan-Chieh
5,772,417 A 6/1998 Stehr et al.
5,832,604 A * 11/1998 Johnson ..... E21B 4/02 29/888.023
5,857,842 A 1/1999 Sheehan
5,906,236 A 5/1999 Adams et al.
6,280,164 B1 8/2001 Kalt et al.
6,336,796 B1 * 1/2002 Cholet ..... F04C 2/1075 418/48
6,364,645 B1 4/2002 Dieterich
6,416,302 B1 7/2002 Achtelik et al.
6,863,508 B2 3/2005 Hauser
7,037,091 B2 5/2006 Chumley et al.
7,134,848 B2 11/2006 Olbert et al.
7,690,901 B2 4/2010 Achtelik et al.
7,740,457 B2 6/2010 Lehmann
8,231,364 B2 7/2012 Mayer et al.
2006/0075801 A1 * 4/2006 Evrard ..... E21B 21/067 73/19.09
2006/0083637 A1 * 4/2006 Marielle ..... F04C 2/1075 418/48
2009/0110579 A1 * 4/2009 Amburgey ..... F04C 2/1075 418/48
2010/0196182 A1 * 8/2010 Loeker ..... F04C 2/1075 418/48
2010/0284842 A1 * 11/2010 Jager ..... F04C 2/1075 418/48
2014/0112814 A1 4/2014 Kudara et al.
2014/0134029 A1 * 5/2014 Coghlan, III ..... F04C 2/1075 418/48
2014/0227121 A1 * 8/2014 Parrett ..... F04C 2/1073 418/48
2015/0139843 A1 5/2015 Meyer et al.

* cited by examiner

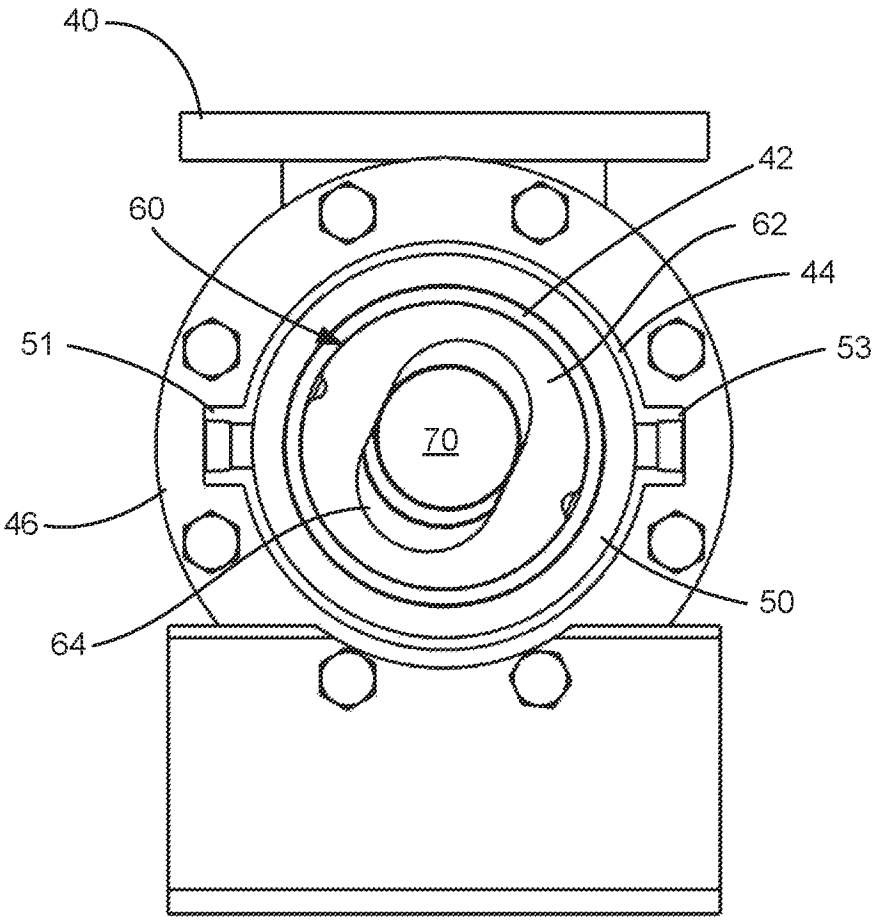
FIG. 5
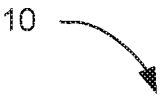

PROGRESSIVE CAVITY PUMP WITH INTEGRATED HEATING JACKET

CROSS-REFERENCE TO RELATED APPLICATION

This application claims priority under 35 U.S.C. § 119, based on U.S. Provisional Patent Application No. 62/478,768 filed Mar. 30, 2017, the disclosure of which is hereby incorporated by reference.

BACKGROUND OF THE INVENTION

The use of progressive cavity, helical, or single-screw rotary devices is well-known in the art, both as pumps and as driving motors. These devices typically include a rotor of helical contour that rotates within a matching stator. The rotor generally has a plurality of lobes or helices, and the stator has matching lobes. Generally, the rotor has one less lobe than the stator to facilitate pumping rotation. The lobes of the rotor and stator engage to form sealing surfaces and cavities therebetween. For a motor, fluid is pumped into the input end cavity at a higher pressure than that at the outlet end, which creates forces that cause the rotor to rotate within the stator. In the case of a helical gear pump, an external power source turns the rotors to draw fluid in the cavities and facilitate pumping of the fluid.

Certain types of fluid for use with progressive cavity pumps may require heating or insulation to maintain above-ambient temperatures while passing through the pump.

BRIEF DESCRIPTION OF THE DRAWINGS

FIG. 5 is a transverse cross-sectional view of the progressive cavity pump along line B-B of FIG. 3;

DETAILED DESCRIPTION OF THE PREFERRED EMBODIMENTS

Figure 1:
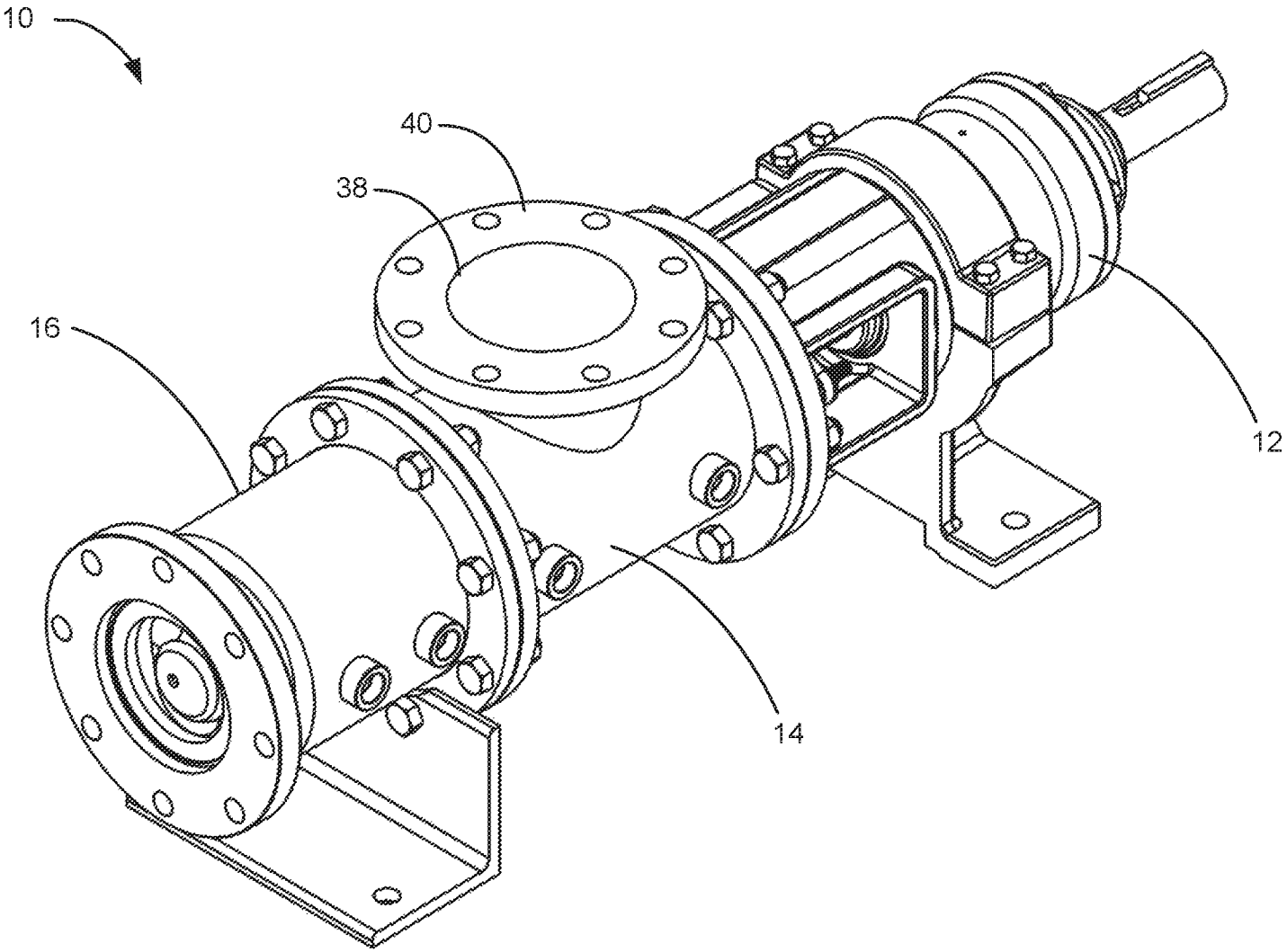
FIG. 1 is a perspective view of a progressive cavity pump with an integrated pump jacket, according to an implementation described herein.

The following detailed description refers to the accompanying drawings. The same reference numbers in different drawings may identify the same or similar elements.

This invention relates to generally to progressive cavity or positive displacement pumps or motors, and more particularly, to progressive cavity pumps used to move heated fluids.

In some applications, progressive cavity pumps are used to move heated fluids. In some instances, these fluids may have different properties at different temperatures. For example, certain paint compositions with abrasives (e.g., hot applied thermoplastic paint for road markings) and other coatings for outdoor applications are heated to high temperatures (e.g., over 200° C.), applied to a surface, and cooled to a hardened state. Premature cooling of such fluids as they pass through a progressive cavity pump can cause clogging and untimely wear of pump components.

According to implementations described herein, a progressive cavity pump is provided with integrated, compartmentalized heating jackets. Separate pump sections are joined to form a contiguous internal bore for pumping heated fluids. Compartmentalized heating chambers may surround individual pump sections. The compartmentalized heating chambers simplify pump assembly and reduce the possibility of heated fluid leaks.

According to an implementation, a progressive cavity pump may include a jacketed stator casing. The jacketed stator casing includes a stator heating chamber, a stator assembly, and a rotor rotatably disposed within the stator assembly. The stator heating chamber may form a cylindrical space around the stator assembly and may receive heating fluid therein. The stator assembly may include a cylindrical wall and a stator segment that forms a helically-convoluted chamber within the cylindrical wall. The stator heating chamber may be isolated from the helically-convoluted chamber.

According to another implementation, the progressive cavity pump may include a jacketed inlet body. The jacketed inlet body may include an inlet heating chamber and a working fluid chamber in fluid communication with a helically-convoluted chamber of a stator casing, such as the jacketed or non-jacketed stator casing. The inlet heating chamber may form a second space around the working fluid chamber and may be configured to receive the heating fluid therein. The inlet heating chamber may be isolated from the working fluid chamber.

According to still another implementation, the progressive cavity pump may include both a jacketed stator casing and a jacketed inlet body. The jacketed stator casing includes a stator heating chamber, a stator assembly, and a rotor rotatably disposed within the stator assembly. The jacketed inlet body may include an inlet heating chamber and a working fluid chamber in fluid communication with a helically-convoluted chamber of the stator assembly. The stator heating chamber and the inlet heating chamber may be isolated from each other, the helically-convoluted chamber, and the working fluid chamber.

Each of the stator heating chamber and the inlet heating chamber may include at least one inlet port and one discharge port. One inlet hose may supply heating fluid (e.g., hot oil or other fluid) to the stator heating chamber via the inlet port. Another inlet hose may supply heating fluid to the inlet heating chamber. To circulate the heating fluid, discharge hoses may remove the heating fluid from the stator heating chamber and the inlet heating chamber via the respective discharge ports. Heat from the heating fluid in the stator heating chamber and the inlet heating chamber may be transferred through thermally-conductive walls that form the stator assembly and the working fluid chamber, respectively.

In the case of the stator assembly, a metal stator segment may provide additional heat transfer to the working fluid path.

Conventional techniques to keep fluid heated when flowing through a progressive cavity pump include using a combination of heating blankets and hoses wrapped around the pump to maintain working fluid temperatures. These techniques, however, have proved to be cumbersome, are subject to field installation variances, and can provide inconsistent heating patterns. Furthermore, the pumping of heated fluids through progressive cavity pumps has conventionally been limited by temperature restrictions when using elastomeric stators.

Figure 2:
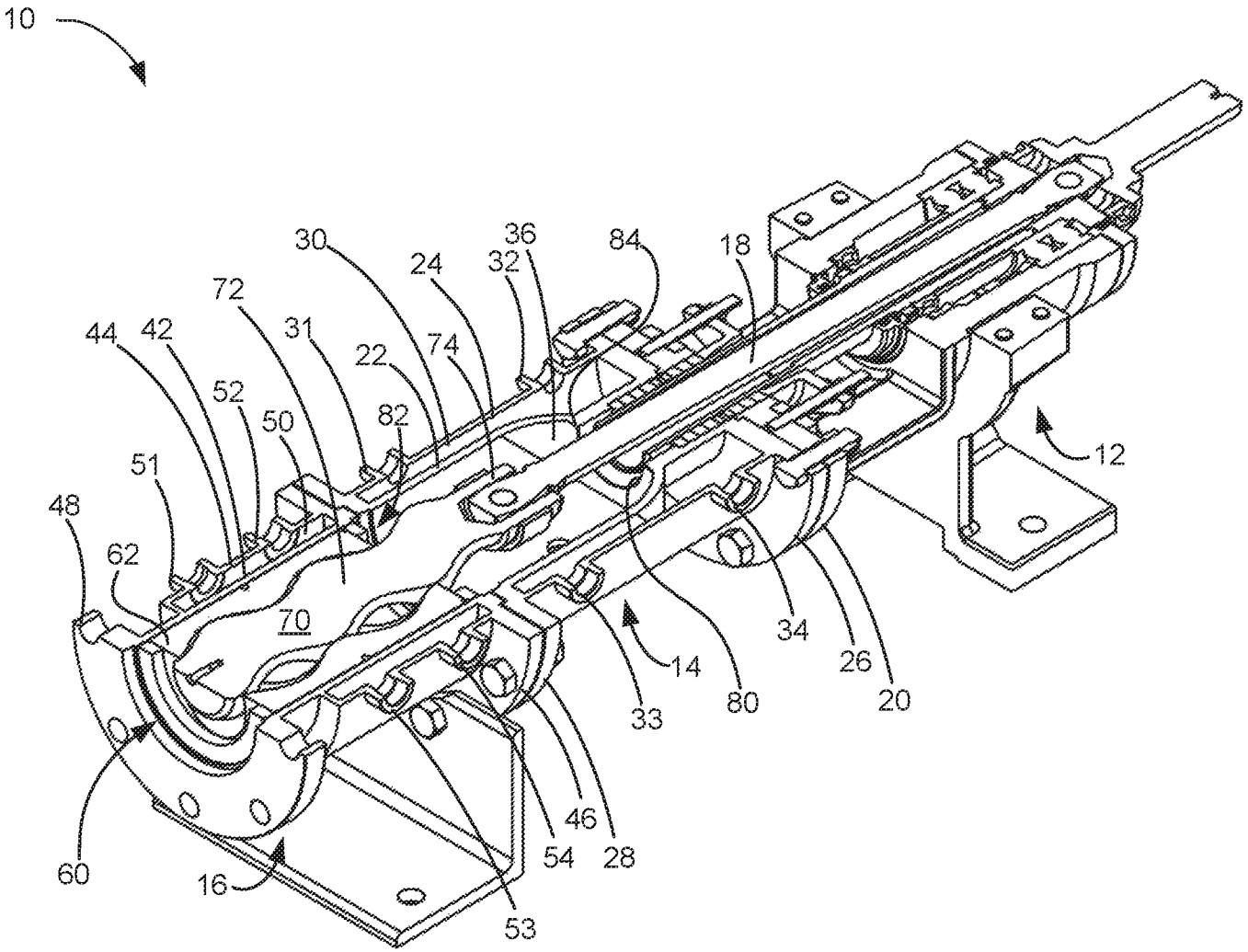
FIG. 2 is a cross-sectional perspective view of the progressive cavity pump of FIG. 1.
Figure 3:
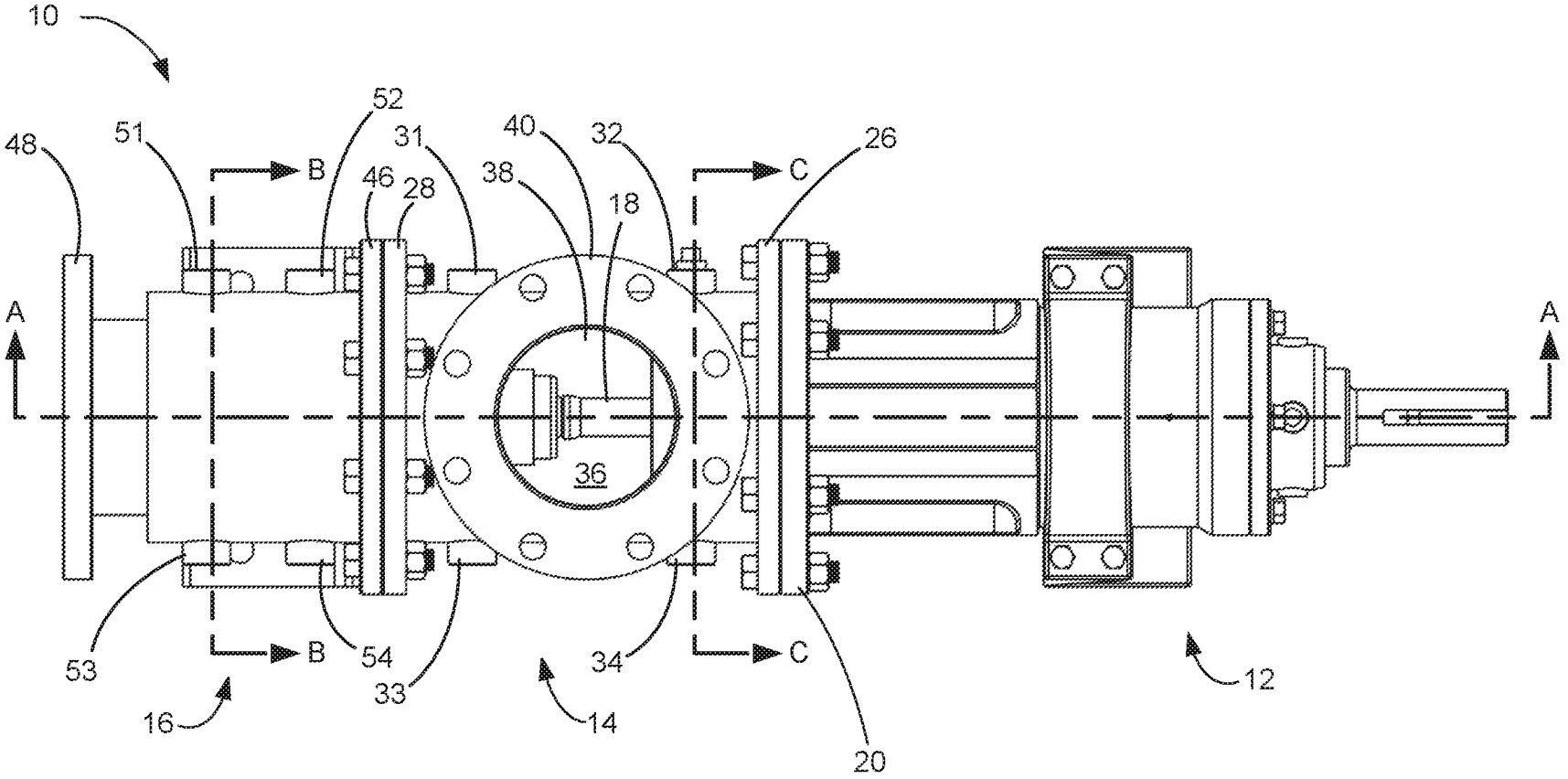
FIG. 3 is a top view of the progressive cavity pump of FIG. 1.
Figure 4:
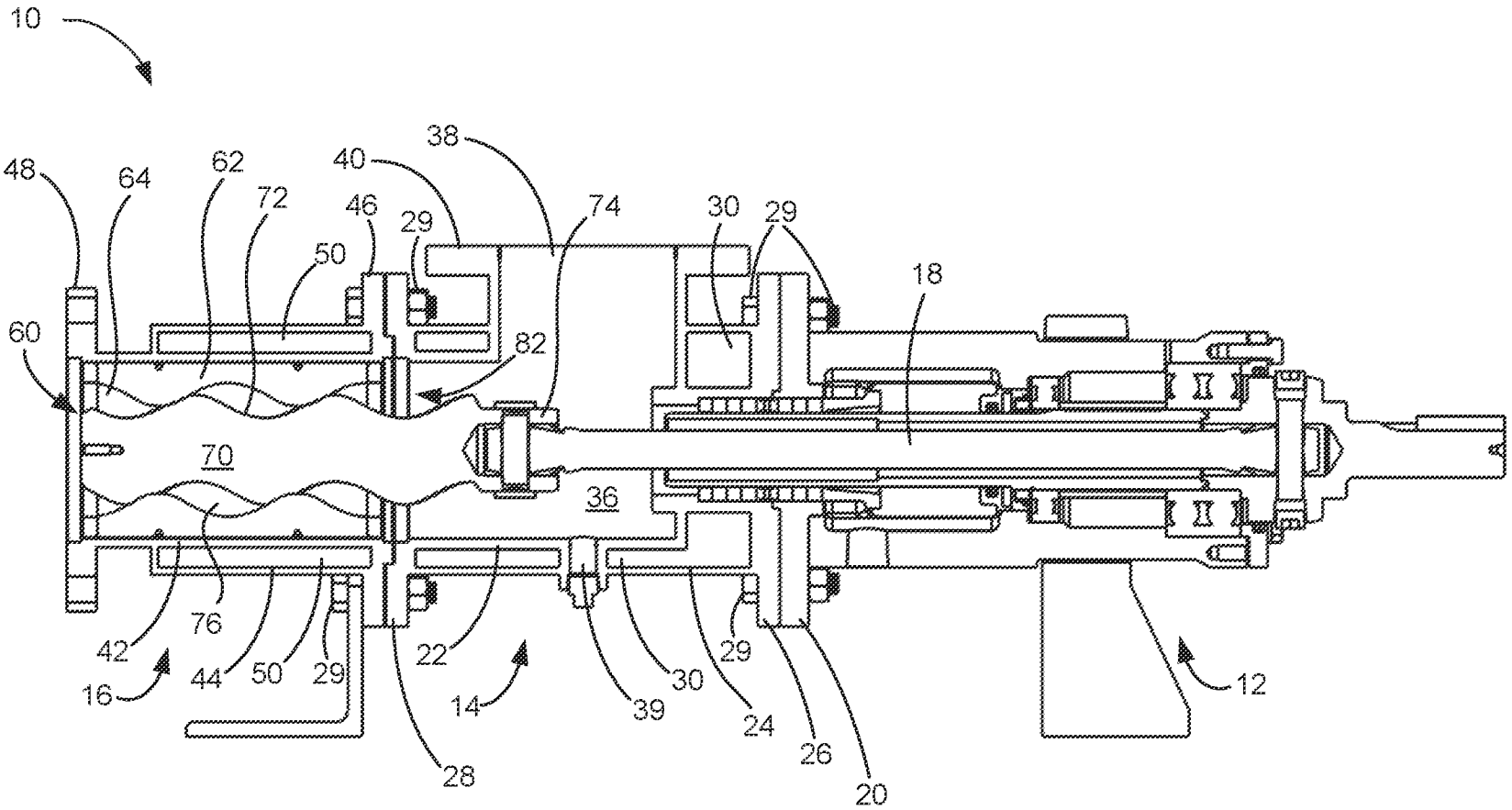
FIG. 4 is a longitudinal cross-sectional view of the progressive cavity pump along line A-A of FIG. 3.
Figure 6:
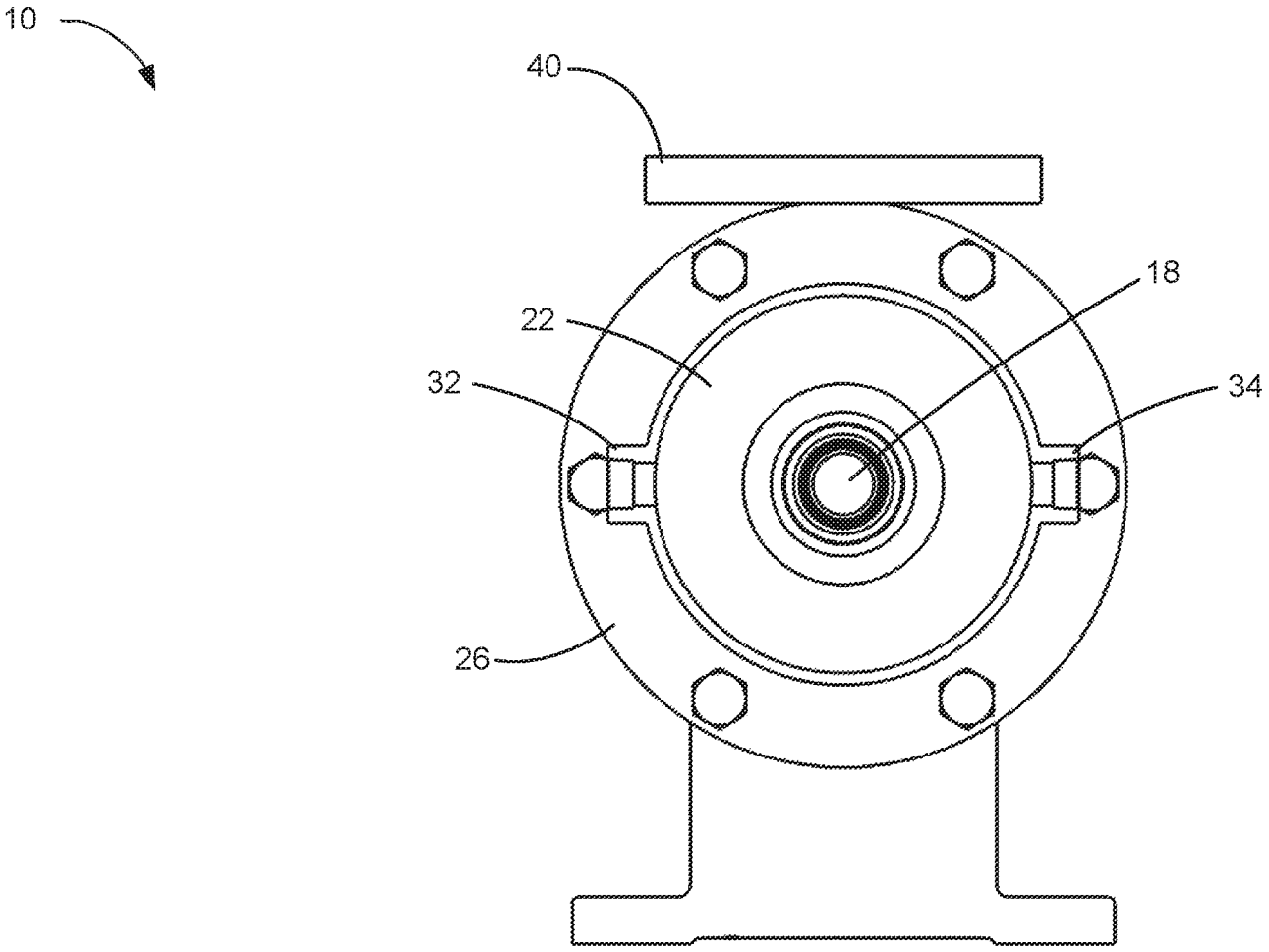
FIG. 6 is a transverse cross-sectional view of the progressive cavity pump along line C-C of FIG. 3.

FIG. 1 provides a perspective view of a progressive cavity pump 10 with integrated, compartmentalized heating jackets, according to an implementation. FIG. 2 is a cross-sectional perspective view of pump 10. FIG. 3 is a top view of pump 10. FIGS. 4-6 provide various cross-sectional views of pump 10. FIGS. 1-6 are referred to collectively in the following description.

Pump 10 includes a drive apparatus 12, a jacketed inlet body 14, and a jacketed stator casing 16. Drive apparatus 12 may include a drive shaft 18 connected to a motor and a flange 20.

Inlet body 14 may generally be in the form of a double-walled tube. An inner wall 22 and an outer wall 24 are separated by a radial space and are enclosed by flanges 26 and 28 to form a heating chamber 30 between inner wall 22 and outer wall 24. Ports 31, 32, 33, and 34 are provided through outer wall 24 to cycle heating fluid (e.g., oil) through heating chamber 30. Ports 31-34 may be used interchangeably as inlet or discharge ports and may include, for example, interior threads to receive supply or discharge tubing for the heating fluid. Multiple ports 31-34 are provided for convenience and to accommodate different supply/discharge tubing arrangements. In one implementation, only two of ports 31-34 may be used at a time, while two other of ports 31-34 may be capped off.

Inner wall 22 substantially encloses a working fluid chamber 36 within inlet body 14. An inlet 38 extends through outer wall 24 and opens into chamber 36 to permit working fluid to bypass heating chamber 30 and enter chamber 36. Additionally, a drain port 39 may extend through outer wall 24 into chamber 36 to permit draining of working fluid from chamber 36. Drain port 39 may be plugged when not in use. Inlet 38 and drain port 39 are sealed against inner wall 22 and outer wall 24 to prevent any mixing of the heating fluid (e.g., in heating chamber 30) and the working fluid (e.g., in chamber 36, inlet 38, and drain port 39). An outside end of inlet 38 may be joined to a flange 40. Flange 40 may be used to secure inlet body 14 to supply piping (not shown) for the working fluid.

Stator casing 16 may be in the form of a double-walled tube. An inner wall 42 and an outer wall 44 of stator casing 16 are separated by a radial space and are enclosed by flanges 46 and 48 to form a heating chamber 50 between inner wall 42 and outer wall 44. Ports 51, 52, 53, and 54 are provided through outer wall 44 to cycle heating fluid (e.g., oil) through heating chamber 50. Ports 51-54 may be used interchangeably as inlet or discharge ports and may include, for example, interior threads to receive supply or discharge tubing for the heating fluid. Multiple ports 51-54 are provided for convenience and to accommodate different supply/discharge tubing arrangements. In one implementation, only two of ports 51-54 may be used at a time, while two other of ports 51-54 may be capped off.

Inner wall 42 provides a cylindrical casing for a stator assembly 60. Stator assembly 60 may include a metal or another conductive material that can withstand the high temperatures of the working fluid and/or the heating fluid. Generally, these temperatures preclude use of rubber and other elastomers. Stator assembly 60 may include a stator segment 62 that forms a helically-convoluted chamber 64 within the cylindrical casing. Stator segment 62 may be formed as a single piece, different segments, or multiple axially-aligned discs. In one implementation, stator segment 62 may be formed from a group of steel discs with apertures therein. In some implementations, stator assembly 60 may include additional support rings, sleeves, bearings, or the like (not shown). In one implementation, materials of stator section 62 may have high thermal conductivity to transfer heat from inner wall 42. A rotor 70 may be rotatably disposed within stator assembly 60. Rotor 70 may include an elongated helically-lobed section 72 and a base portion 74. Inner wall 42 may include openings at either end of stator assembly 60 such that rotor 70 may extend longitudinally through stator assembly 60.

Inlet body 14 may be connected to drive apparatus 12 by securing flange 26 to flange 20. For example, threaded fasteners 29 may be inserted through aligned holes in each of flange 26 and flange 20. Similarly, stator casing 16 may be connected to inlet body 14 by securing flange 46 to flange 28. As shown, for example, in FIG. 2, inner wall 22 includes an opening 80 at one end of chamber 36 to permit insertion of drive shaft 18. Drive shaft 18 may be coupled to rotor 70 within chamber 36. Inner wall 22 may also include an opening 82 at an opposite end of chamber 36 to permit extension of rotor 70 into chamber 36 and to permit fluid communication between chamber 36 and stator assembly 60. As shown, for example, in FIG. 2 the radial space between inner wall 22 and outer wall 24 is not uniform due to a step change in the diameter of inner wall 22 at a shoulder 84 around the area of opening 80.

The helically-convoluted chamber 64 of stator assembly 60 may include, for example, at least one more lobe than in helically-lobed section 72, which creates gaps 76 between stator segment 62 and rotor 70 along the longitudinal length therebetween. These gaps 76 progressively move along the length between stator segment 62 and rotor 70, as rotor 70 rotates within stator segment 62, and progressively moves working fluid in the gaps 76 from working chamber 36 at one end of stator segment 62 to the pump exit at the other end.

Rotor 70 may be formed from a metal material, which may be the same or different material than that of stator segment 62. In one implementation, rotor 70 may be made of alloy steel and provided with a smooth coated surface, such as a chrome surface. In one implementation, all or portions of inlet body 14 (e.g., inner wall 22, outer wall 24, and flanges 26 and 28) and stator casing 16 (e.g., inner wall 42, outer wall 44, and flanges 46 and 48) may also be machined from a metal material, such as steel. In another implementation, inlet body 14 and stator casing 16 may be cast from iron or another material.

According to embodiments described herein, heating chamber 50 may be isolated (or compartmentalized) from heating chamber 30 of inlet body 14; and both heating chamber 30 and heating chamber 50 may be isolated from chamber 36 and helically-convoluted chamber 64. In other words, there is not fluid communication between heating chamber 30 and any of working fluid chamber 36, heating chamber 50, and helically-convoluted chamber 64. Similarly, there is not fluid communication between heating chamber 50 and any of working fluid chamber 36, heating chamber 30, and helically-convoluted chamber 64. Isolation of heating chamber 30 and heating chamber 50 may allow for easier alignment of inlet body 14 with stator casing 16, may provide improved circulation of heating fluid within each of heating chambers 30/50, and may simplify sealing of the separate inlet body 14 and stator casing 16 components during assembly.

Figure 7:
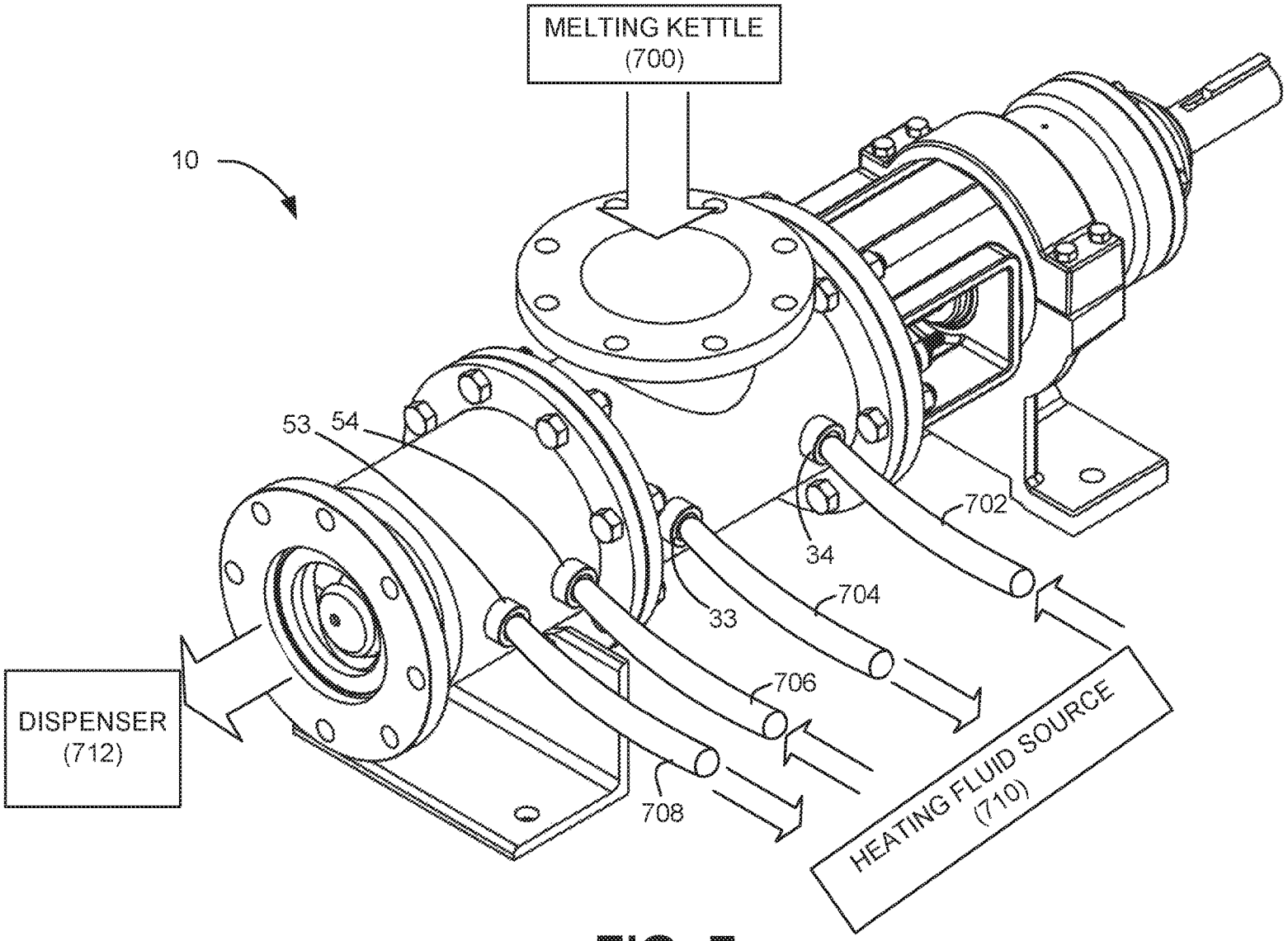
FIG. 7 is a schematic diagram of the progressive cavity pump of FIG. 1 in operation.

FIG. 7 provides a schematic of pump 10 in operation. A supply source, such as piping from a melting kettle 700, is connected to flange 40 of inlet body 14. An input line 702 is connected to one of ports 31-34 (e.g., port 34, as shown in the example of FIG. 7) of inlet body 14 to provide heating fluid from a heating fluid source 710. A discharge line 704 is connected to a different one of ports 31-34 (e.g., port 33) to return heating fluid to heating fluid source 710. The unused ports of ports 31-34 (e.g., ports 31 and 32) are plugged.

Additionally, another input line 706 is connected to one of ports 51-54 (e.g., port 54, as shown in the example of FIG. 7) of stator casing 16 to provide heating fluid from heating fluid source 710. Another discharge line 708 is connected to a different one of ports 51-54 (e.g., port 53) to return heating fluid to heating fluid source 710. The unused ports of ports 51-54 (e.g., ports 51 and 52) are plugged.

Once all the ports 31-34 and 51-54 are connected or plugged, heating fluid from heating fluid source 710 is cycled through heating chamber 30 of inlet body 14 and heating chamber 50 of stator casing 16. In one implementation, the heating fluid (e.g., oil) may be supplied at or above the temperature of the working fluid (e.g., over 200° C.). For example, lines 702-708 may connect to the same heating fluid source used for heating melting kettle 700. In other implementations, lower heating fluid temperatures may be used for different working fluids or different purposes (e.g., heating fluid may be provided at 100° C. to slow, but not prevent, cooling of the working fluid.)

Hot working fluid (e.g., hot applied thermoplastic paint) is supplied from melting kettle 700 into inlet body 14 via inlet 38. The working fluid is pumped from working chamber 36 through helically-convoluted chamber 64 of stator casing 16. Heating fluid cycled through heating chamber 30 may supply heat that is transferred through inner wall 22 to maintain the temperature of the working fluid in working chamber 36. Similarly, heating fluid cycled through heating chamber 50 may supply heat that is transferred through inner wall 42. Stator segment 62 may conduct heat from inner wall 42 to maintain the temperature of the working fluid passing through helically-convoluted chamber 64. The working fluid may flow into a dispensing device 712—such as a ribbon dispenser, a sprayer, or an extrusion device—that is connected to flange 48.

Figure 8:
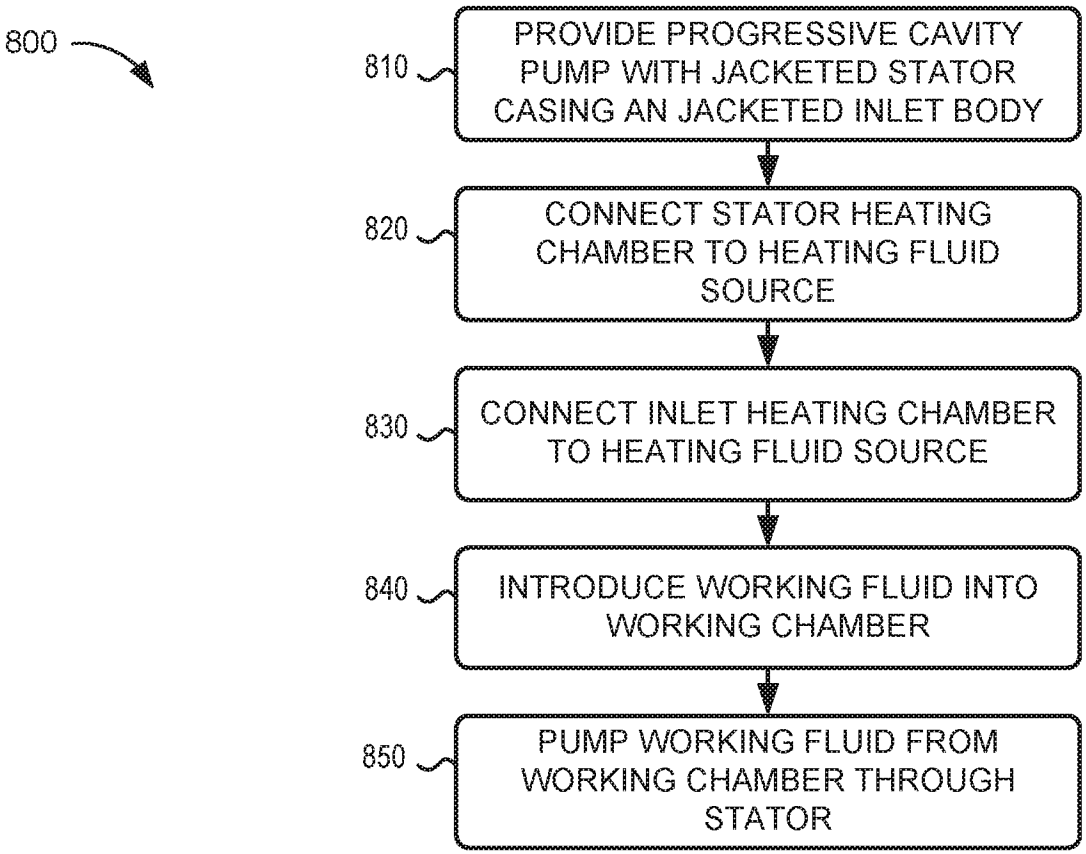
FIG. 8 is a flow diagram of a process for moving high-temperature fluid through a progressive cavity pump, according to an implementation described herein.

FIG. 8 is a flow diagram for a process 800 for moving high-temperature fluid through a progressive cavity pump according to an implementation described herein. As shown in FIG. 8, process 800 may include providing a progressive cavity pump that includes a jacketed stator casing and a jacketed inlet body (block 810). For example, pump 10 may include jacketed inlet body 14 and jacketed stator casing 16. Jacketed stator casing 16 may include a heating chamber 50 in fluid isolation from a helically-convoluted chamber 64 in a stator assembly 60. Rotor 70 may be rotatably disposed within stator assembly 60. Jacketed inlet body 14 may include heating chamber 30 in fluid isolation from a working fluid chamber 36, and working fluid chamber 36 in fluid communication with helically-convoluted chamber 64.

Process 800 may also include connecting the stator heating chamber to a heating fluid source (block 820), and connecting the inlet heating chamber to heating fluid source (block 830). For example, input line 702 may be connected to one of ports 31-34 of inlet body 14 to provide heating fluid from heating fluid source 710. Similarly, input line 706 may be connected to one of ports 51-54 of stator casing 16 to provide heating fluid from heating fluid source 710. Discharge line 704 may be connected to a different port of inlet body 14 and discharge line 708 may be connected to a different port of stator casing 16 to recirculate the heating fluid.

Process 800 may further include introducing a working fluid into the working chamber (block 840), and pumping the working fluid from the working chamber through the helically-convoluted chamber (block 850). For example, hot working fluid may be fed from melting kettle 700 into inlet body 14 via inlet 38. The working fluid may be pumped from working chamber 36 through helically-convoluted chamber 64 of stator casing 16, where the working fluid may be dispensed, for example, by dispensing device 712.

While a series of blocks has been described with respect to FIG. 8, the order of the blocks may be modified in other implementations. Further, non-dependent blocks may be performed in parallel. In still other implementations, some blocks may be eliminated. For example, for pumps with only a jacketed stator casing or only a jacketed inlet body, as described below, blocks relating to those pump sections may not be performed.

Figure 9:
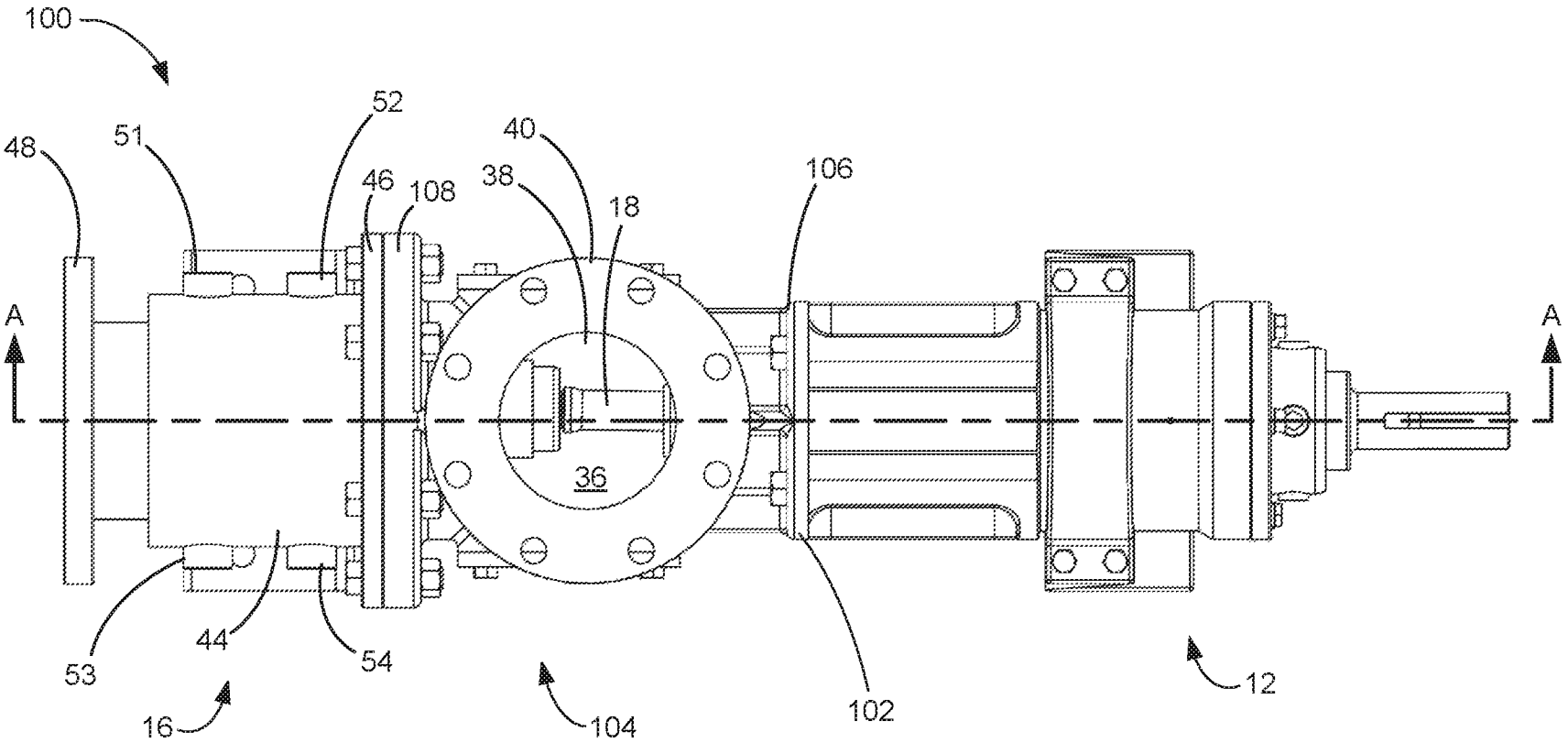
FIG. 9 is a top view of a progressive cavity pump with a jacketed stator casing, according to another implementation described herein.
Figure 10:
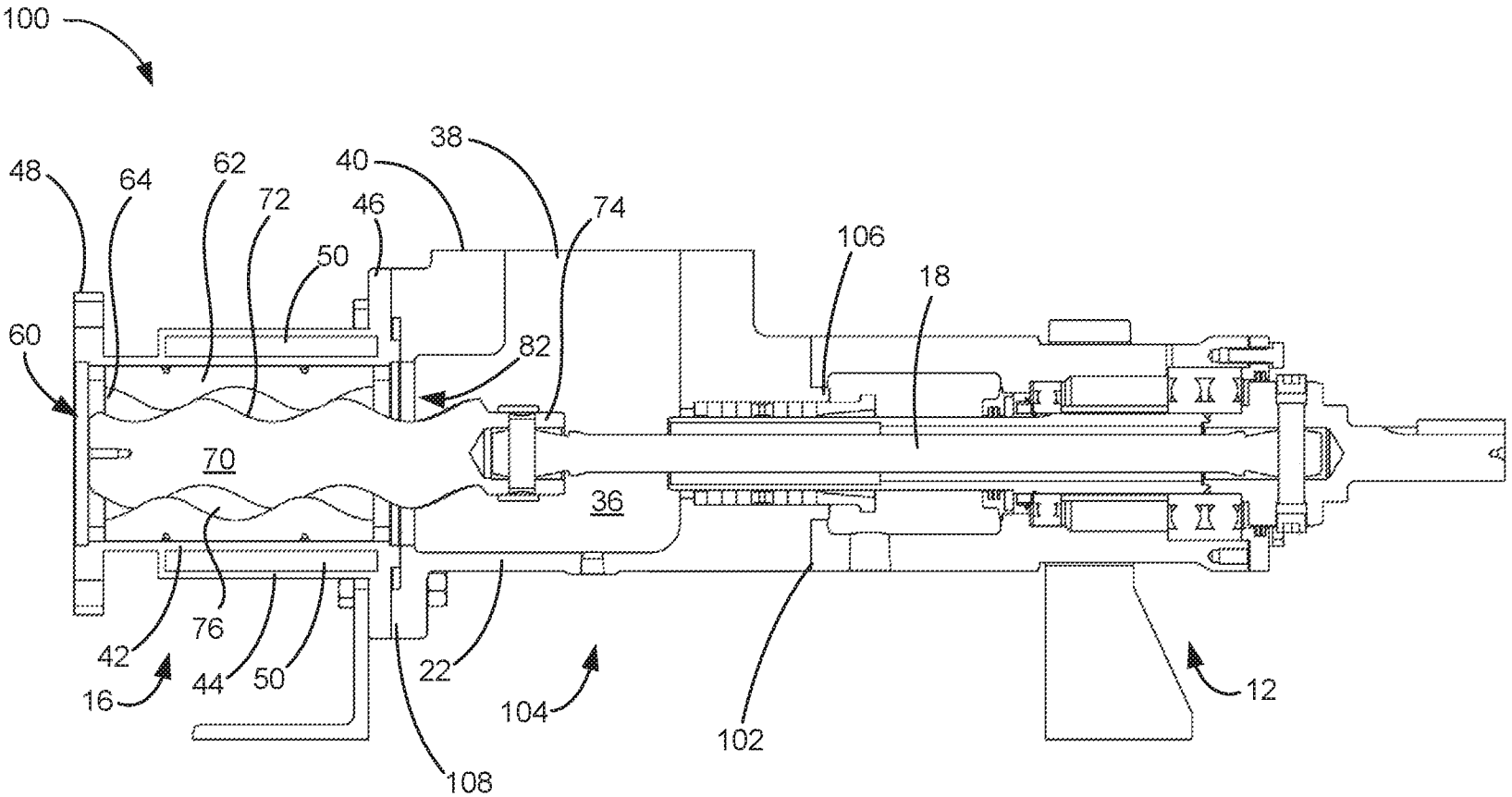
FIG. 10 is a longitudinal cross-sectional view of the progressive cavity pump along line A-A of FIG. 9.

FIG. 9 provides a top view of a progressive cavity pump 100 with integrated, compartmentalized heating jacket for a stator segment, according to another implementation. FIG. 10 is a longitudinal cross-sectional view of progressive cavity pump 100 along line A-A of FIG. 9.

Referring collectively to FIGS. 9 and 10, pump 100 includes drive apparatus 12, jacketed stator casing 16, and a non-jacketed inlet body 104. Drive apparatus 12 and jacketed stator casing 16 may include features described above in connection with, for example, FIGS. 1-8.

Non-jacketed inlet body 104 may generally be in the form of a single-walled tube with interface 106 and flange 108 on opposite ends of non-jacketed inlet body 104. Inner wall 22 substantially encloses working fluid chamber 36 within inlet body 104. Inlet 38 opens into chamber 36 to permit working fluid enter chamber 36. Inlet 38 is sealed against inner wall 22 to prevent fluid leakage. An outside end of inlet 38 may be joined to flange 40. Flange 40 may be used to secure inlet body 104 to supply piping (not shown) for the working fluid.

Interface 106 may connect to an end 102 of drive apparatus 12. Flange 108 may be configured to mate to flange 46 of jacketed stator casing 16. In the example of FIGS. 9 and 10, flange 108 may have a larger diameter than would be required if inlet body 104 were to be secured to a non-jacketed stator casing.

Thus, in the configuration of FIGS. 9 and 10, pump 100 uses heating fluid only around jacketed stator casing 16. Similar to the configuration shown in FIG. 7, pump 100 may use one of ports 51-54 on stator casing 16 to provide heating fluid from heating fluid source 710 and a different one of ports 51-54 to return heating fluid to heating fluid source 710. The unused ports of ports 51-54 (e.g., ports 51 and 52) are plugged. Once all the ports 51-54 are connected or plugged, heating fluid from heating fluid source 710 can be cycled through heating chamber 50 of stator casing 16.

Figure 11:
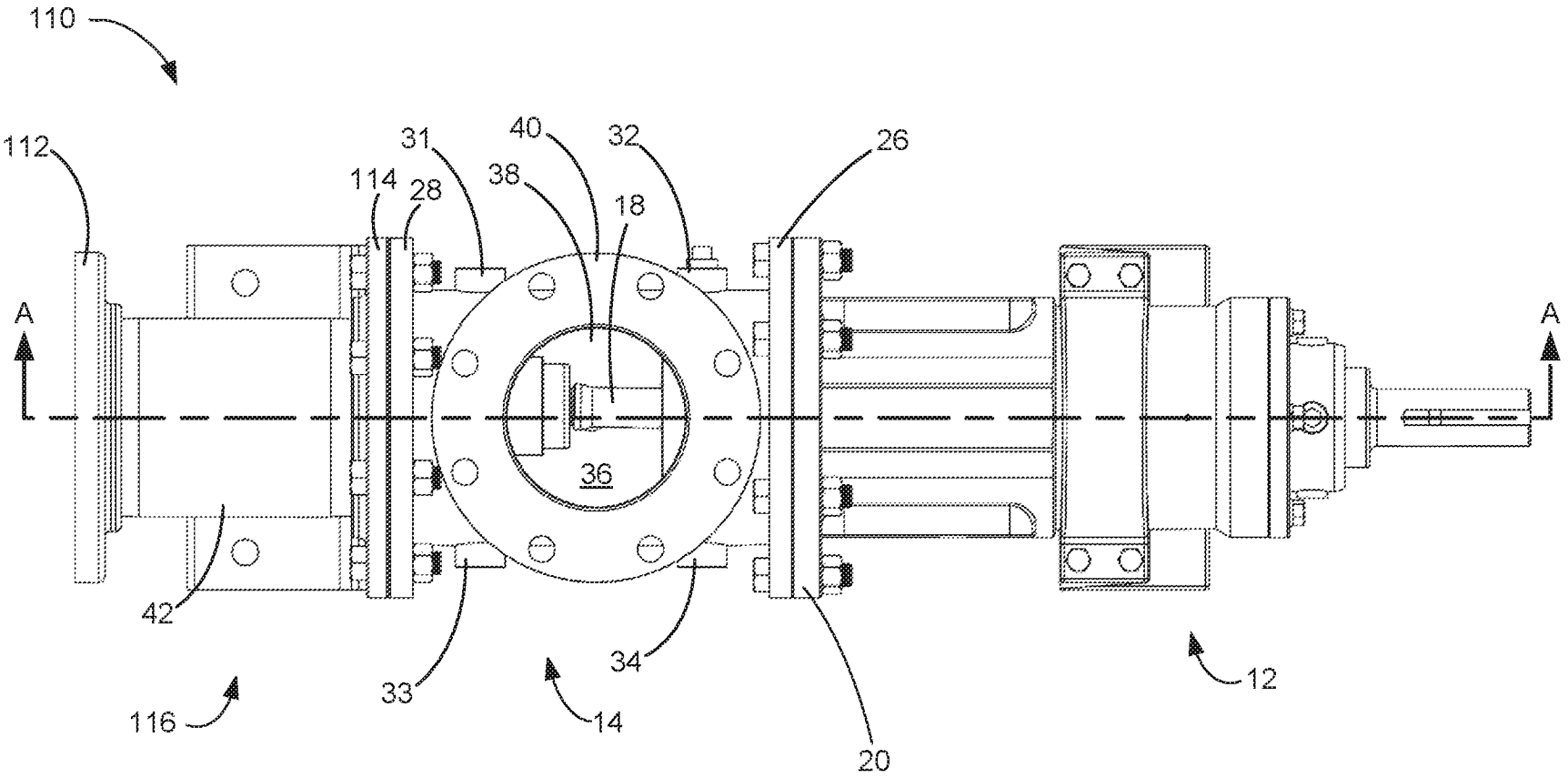
FIG. 11 is a top view of a progressive cavity pump with a jacketed inlet body, according to still another implementation described herein.
Figure 12:
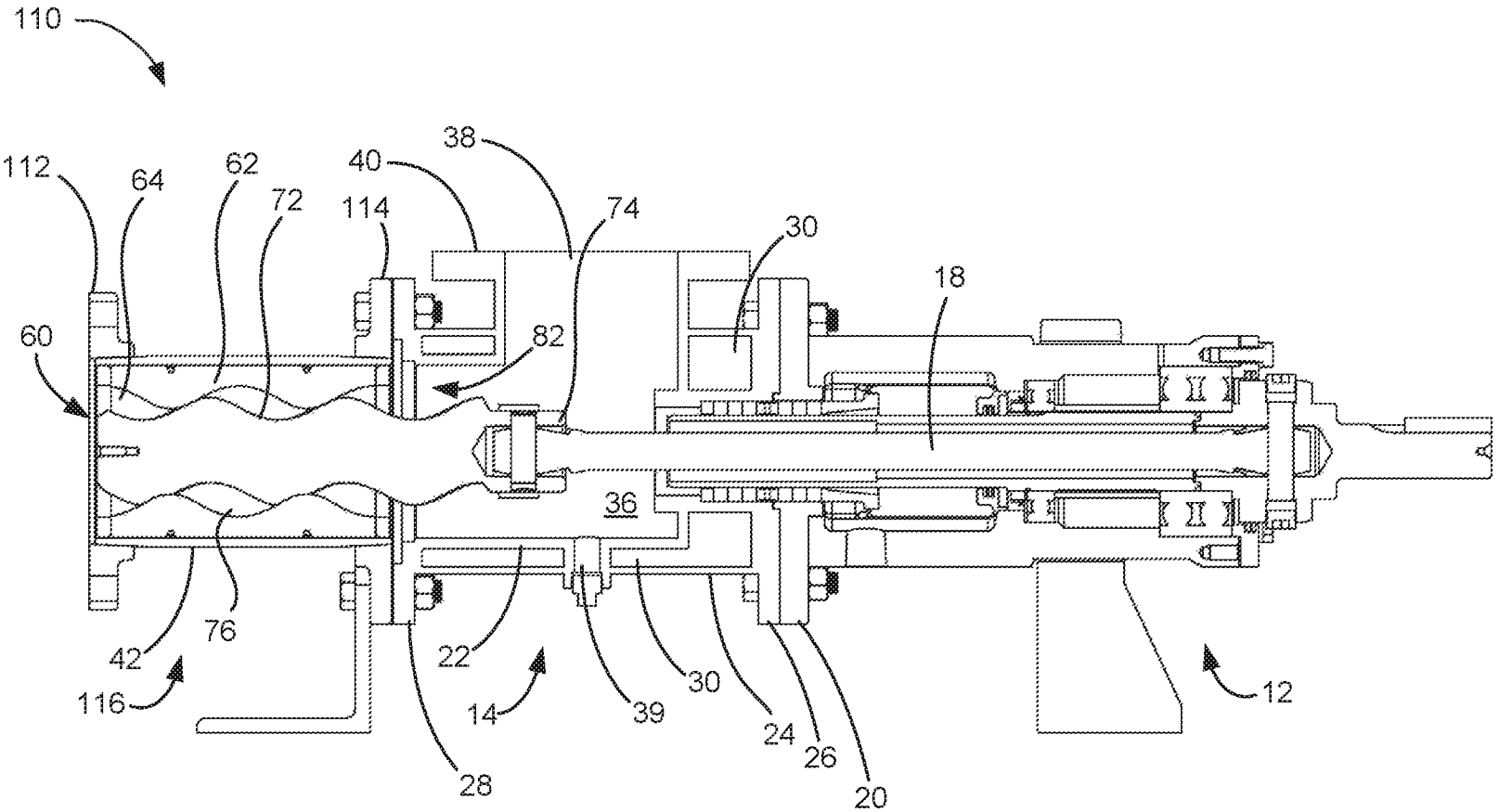
FIG. 12 is a longitudinal cross-sectional view of the progressive cavity pump along line A-A of FIG. 11.

FIG. 11 provides a top view of a progressive cavity pump 110 with integrated, compartmentalized heating jacket for an inlet body, according to another implementation. FIG. 12 is a longitudinal cross-sectional view of progressive cavity pump 110 along line A-A of FIG. 11.

Referring collectively to FIGS. 11 and 12, pump 110 includes drive apparatus 12, jacketed inlet body 14, and a non-jacketed stator casing 116. Drive apparatus 12 and jacketed inlet body 14 may include features described above in connection with, for example, FIGS. 1-8.

Non-jacketed stator casing 116 may be in the form of a single-walled tube with flange 112 and flange 114 on opposite ends of non-jacketed stator casing 116. Inner wall 42 provides a cylindrical casing for stator assembly 60 with rotor 70 rotatably disposed within stator assembly 60. Inner wall 42 may include openings at either end of stator assembly 60 such that rotor 70 may extend longitudinally through stator assembly 60 and into chamber 36 of jacketed inlet body 14. Stator casing 116 may be connected to inlet body 14 by securing flange 114 to flange 28. In the example of FIGS. 11 and 12, flange 114 may have a larger diameter than would be required if stator casing 116 were to be secured to a non-jacketed inlet body.

Thus, in the configuration of FIGS. 11 and 12, pump 110 uses heating fluid only around jacketed inlet body 14. Similar to the configuration shown in FIG. 7, pump 110 may use one of ports 31-34 on inlet body 14 to provide heating fluid from heating fluid source 710 and a different one of ports 31-34 to return heating fluid to heating fluid source 710. The unused ports of ports 31-34 (e.g., ports 31 and 32) may be plugged. Once all the ports 31-34 are connected or plugged, heating fluid from heating fluid source 710 can be cycled through heating chamber 30 of inlet body 14.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

What is claimed is:

1. A progressive cavity pump, comprising:

a jacketed stator casing, the jacketed stator casing including a stator heating chamber, a stator assembly, a first flange at an end of the jacketed stator casing, and a rotor rotatably disposed within the stator assembly, wherein the stator heating chamber includes a first radial space around the stator assembly configured to receive heating fluid therein, wherein the stator assembly includes an inner wall and a stator segment that forms a helically-convoluted chamber within the inner wall, wherein the stator heating chamber is isolated from the helically-convoluted chamber, wherein the inner wall and the stator segment each comprise a thermally conductive metal material configured to withstand heating fluid temperatures above 200 degrees C., and wherein the inner wall and the stator segment are configured to transfer heat from the heating fluid to a working fluid within the helically-convoluted chamber; and a jacketed inlet body, the jacketed inlet body including an inlet heating chamber, a working fluid chamber in fluid communication with the helically-convoluted chamber, and a second flange at an end of the jacketed inlet body, wherein the inlet heating chamber includes a second radial space around the working fluid chamber configured to receive the heating fluid therein, and wherein the first flange of the jacketed stator casing and the second flange of the jacketed inlet body are connected and permit extension of the rotor into the working fluid chamber.

2. The progressive cavity pump of claim 1, wherein the jacketed stator casing further comprises a first inlet port to receive the heating fluid and a first discharge port to expel the heating fluid form the stator heating chamber.

3. The progressive cavity pump of claim 1, wherein the stator heating chamber and the inlet heating chamber are isolated from each other, the helically-convoluted chamber, and the working fluid chamber.

4. The progressive cavity pump of claim 3, wherein the jacketed inlet body further comprises a second inlet port to receive the heating fluid and a second discharge port to expel the heating fluid form the inlet heating chamber.

5. The progressive cavity pump of claim 4, wherein the first flange of the jacketed stator casing and the second flange of the jacketed inlet body are connected using threaded fasteners.

6. The progressive cavity pump of claim 1, wherein the jacketed stator casing and the jacketed inlet body comprise a metal material.

7. The progressive cavity pump of claim 1, further comprising a drive apparatus, the drive apparatus including a drive shaft that is coupled to the rotor within the working fluid chamber.

8. The progressive cavity pump of claim 1, wherein the jacketed inlet body further includes an inlet that extends through the inlet heating chamber into the working fluid chamber.

9. The progressive cavity pump of claim 8, wherein the jacketed inlet body further includes a pluggable drain port that extends through the inlet heating chamber into the working fluid chamber.

10. The progressive cavity pump of claim 1, wherein the second radial space is non-uniform.

11. The progressive cavity pump of claim 1, wherein the working fluid comprises a thermoplastic paint.

12. The progressive cavity pump of claim 1, wherein the stator segment does not include an elastomer.

13. A method of processing high temperature fluid through a progressive cavity pump, the method comprising:

providing the progressive cavity pump, the pump comprising:

a jacketed stator casing, the jacketed stator casing including a stator heating chamber, a stator assembly, a first flange at an end of the jacketed stator casing, and a rotor rotatably disposed within the stator assembly, the stator heating chamber including a first radial space around the stator assembly and configured to receive heating fluid therein, the stator assembly including a cylindrical inner wall and a stator segment that forms a helically-convoluted chamber within the cylindrical inner wall, and the stator heating chamber being isolated from the helically-convoluted chamber, wherein the cylindrical inner wall and the stator segment each comprise a thermally conductive metal material configured to withstand heating fluid temperatures above 200 degrees C., and wherein the cylindrical inner wall and the stator segment are configured to transfer heat from the heating fluid to a working fluid within the helically-convoluted chamber, and a jacketed inlet body, the jacketed inlet body including an inlet heating chamber, a working fluid chamber in fluid communication with the helically-convoluted chamber, and a second flange at an end of the jacketed inlet body, wherein the inlet heating chamber includes a second radial space around the working fluid chamber configured to receive the heating fluid therein, and wherein the first flange of the jacketed stator casing and the second flange of the jacketed inlet body are connected and permit extension of the rotor into the working fluid chamber;

connecting the stator heating chamber to a heating fluid source; and pumping the working fluid through the helically-convoluted chamber.

14. The method of claim 13, wherein connecting the stator heating chamber to the heating fluid source further comprises:

connecting an input line from the heating fluid source to a port for the stator heating chamber, and connecting a discharge line from a port for the stator heating chamber to the heating fluid source.

15. The method of claim 14, wherein the stator heating chamber and the inlet heating chamber are isolated from each other, the helically-convoluted chamber, and the working fluid chamber, the method further comprising:

connecting the inlet heating chamber to the heating fluid source;

introducing a working fluid into the working chamber; and pumping the working fluid from the working chamber.

16. The method of claim 15, wherein connecting the inlet heating chamber to the heating fluid source further comprises:

connecting a different input line from the heating fluid source to a port for the inlet heating chamber, and connecting a different discharge line from a port for the inlet heating chamber to the heating fluid source.

17. The method of claim 16, further comprising:

plugging unused ports for the stator heating chamber and the inlet heating chamber.

18. A progressive cavity pump, comprising:

a jacketed stator casing, the jacketed stator casing including a stator heating chamber, a stator assembly, a first flange at an end of the jacketed stator casing, and a rotor rotatably disposed within the stator assembly; and a jacketed inlet body, the jacketed inlet body including an inlet heating chamber and a working fluid chamber, the working fluid chamber being in fluid communication with a helically-convoluted chamber of the stator assembly, and a second flange at an end of the jacketed inlet body, wherein the jacketed inlet body includes a first inner wall that forms the working fluid chamber within the first inner wall;

wherein the inlet heating chamber includes a first radial space around the working fluid chamber configured to receive heating fluid therein, wherein the inlet heating chamber is isolated from the working fluid chamber, wherein the first inner wall comprises a thermally conductive metal material configured to withstand heating fluid temperatures above 200 degrees C., wherein the first inner wall is configured to transfer heat from the heating fluid to a working fluid within the working fluid chamber, wherein the stator heating chamber and the inlet heating chamber are isolated from each other, and wherein the first flange of the jacketed stator casing and the second flange of the jacketed inlet body are connected and permit extension of the rotor into the working fluid chamber.

19. The progressive cavity pump of claim 18, wherein the jacketed inlet body further comprises a first inlet port to receive the heating fluid and a first discharge port to expel the heating fluid form the inlet heating chamber.

20. The progressive cavity pump of claim 18, wherein the stator heating chamber includes a second radial space around the stator assembly configured to receive the heating fluid therein, wherein the stator assembly includes a second inner wall and a stator segment that forms the helically-convoluted chamber within the second inner wall, wherein the stator heating chamber is isolated from the helically-convoluted chamber, wherein the second inner wall and the stator segment each comprise a thermally conductive metal material configured to withstand heating fluid temperatures above 200 degrees C., and wherein the second inner wall and the stator segment are configured to transfer heat from the heating fluid to the working fluid within the helically-convoluted chamber.

* * * * *